US006126240A

United States Patent [19]

Tse

[11] Patent Number: 6,126,240

[45] Date of Patent: Oct. 3, 2000

[54] STUFFED CHILD'S STOOL

[76] Inventor: Kim Tse, 15051 Avenida Compadres, Chino Hills, Calif. 91709

[21] Appl. No.: 09/365,388

[22] Filed: Aug. 2, 1999

[51] Int. Cl.[7] ..... A47C 7/02

[52] U.S. Cl. ..... 297/461; 297/181; 297/219.12; 297/224; 297/228.11

[58] Field of Search ..... 297/461, 181, 297/219.12, 224, 228.11; D6/345, 351, 358, 359

[56] References Cited

U.S. PATENT DOCUMENTS

| | | | |
|---|---|---|---|
| D. 111,968 | 11/1938 | Holmes, Jr. . | |
| D. 218,817 | 9/1970 | Schildknecht | D6/1 |
| D. 270,587 | 9/1983 | O'Connell | D6/11 |
| D. 277,245 | 1/1985 | Unverzagt | D6/351 |
| D. 288,992 | 3/1987 | Underlugt | D6/345 |
| D. 297,788 | 9/1988 | Fuston et al. | D6/345 |
| D. 314,870 | 2/1991 | Walsh | D6/358 |
| D. 351,950 | 11/1994 | Bird et al. | D6/351 |
| D. 356,449 | 3/1995 | Frye | D6/359 |
| D. 359,170 | 6/1995 | Lyons et al. | D6/359 |
| 3,008,763 | 11/1961 | Lebow | 297/181 |
| 3,737,196 | 6/1973 | Bodor | 297/181 |
| 4,133,064 | 1/1979 | Petrusek | 5/341 |
| 4,586,747 | 5/1986 | Taylor | 297/250 |
| 4,676,551 | 6/1987 | McDowell | 297/461 X |
| 4,909,573 | 3/1990 | Barry et al. | 297/181 X |
| 5,026,315 | 6/1991 | Chap | 446/372 |
| 5,112,104 | 5/1992 | De Giacomi | 297/181 X |
| 5,137,335 | 8/1992 | Marten | 297/181 X |
| 5,507,551 | 4/1996 | Barry | 297/181 |
| 5,551,749 | 9/1996 | Reher et al. | 297/181 X |
| 5,941,599 | 8/1999 | Roberts | 297/181 X |

*Primary Examiner*—Laurie K. Cranmer
*Attorney, Agent, or Firm*—Dennis W. Beech

[57] ABSTRACT

The stuffed child's stool has a typical seat and four legs for the structural members. These are then covered with a cloth material which is stuffed. There may or may not be a back portion attached to the seat for support. A shaped character, such as a bear, with head, partial shoulders and arms extending therefrom is attached around the edge of the stool, and over the back portion if one is included. The arms may or may not be attached around the seat edge. The head and arms which extend partially around the edge appear as a back and arms for the stool. The feet of the character may be formed with the shaped cloth material and stuffing.

8 Claims, 3 Drawing Sheets

STUFFED CHILD'S STOOL

BACKGROUND OF THE INVENTION

1. Field of the Invention

This invention relates to stools that are covered with material having a portion shaped as a character such as an animal and including stuffing material therein. The new device combines the normally flat seat of the stool with a character head and arms that serve as back and arm supports as well as an amusement device to stimulate a child's imagination. The stool legs are covered and stuffed to appear as the character legs and, to protect from injury from contact with a hard object.

2. Description of Related Art

There are currently known in the art various forms of stools or chairs which may have animal shapes. Examples include U.S. Pat. No. 4,586,747 which is illustrated as a bear and has an adjustable platform seat. The functional structure is relatively complex and the structural material is relatively firm, stiff and hard. Another example is U.S. Pat. No. DES 356,449 which is depicted as a rigid construction chair shaped as an animal. U.S. Pat. No. DES 351,950 is a step stool with a storage compartment in the shape of a character that in appearance is rigid material such as plastic to serve as a step stool.

The present invention uses the general shape of a typical four legged stool and adds a relatively short back member in the shape of a character head. The character arms are formed to partially extend around the edge of the stool seat. The entire structure is stuffed or cushioned including the legs which are formed to appear as four character legs. As shown in the drawings for the preferred embodiment, a bear is depicted; however, any general four limb character would be appropriate. The stuffing and shaping transforms the stool into a character for a child's amusement to stimulate imagination and for play while providing protection from injury against hard structural elements.

SUMMARY OF THE INVENTION

One object of the invention is a safer child's stool which also serves as a source of amusement and stimulation for play. Another object is some amount of back support when seated on the stool. A further object is ease of removal of the stool covering for cleaning.

In accordance with the description presented herein, other objectives of this invention will become apparent when the description and drawings are reviewed.

DESCRIPTION OF THE PREFERRED EMBODIMENT

The stuffed child's stool has structural members of a seat and four legs and may have a back member. The structural members are covered with cloth material shaped and decorated to generally represent a character which for the preferred embodiment is illustrated as a bear. The covering is stuffed to create a plush or shaped appearance over the structural elements.

Figure 2:
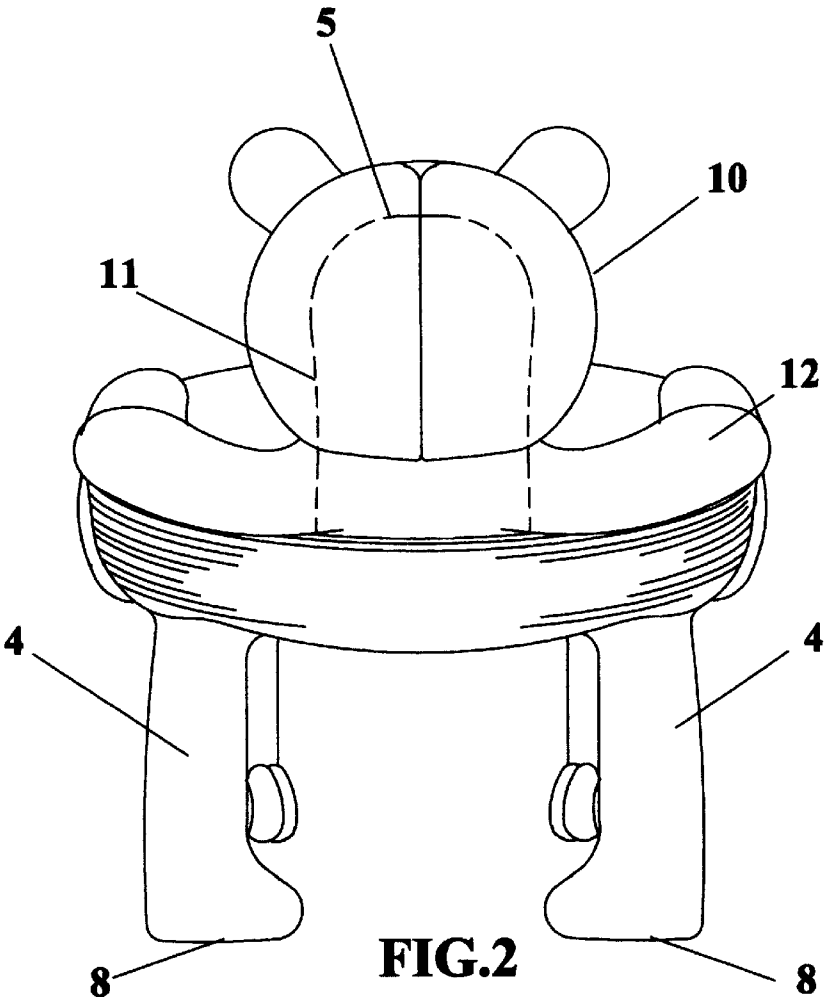
FIG. 2 illustrates a side perspective view of the stool.
Figure 1:
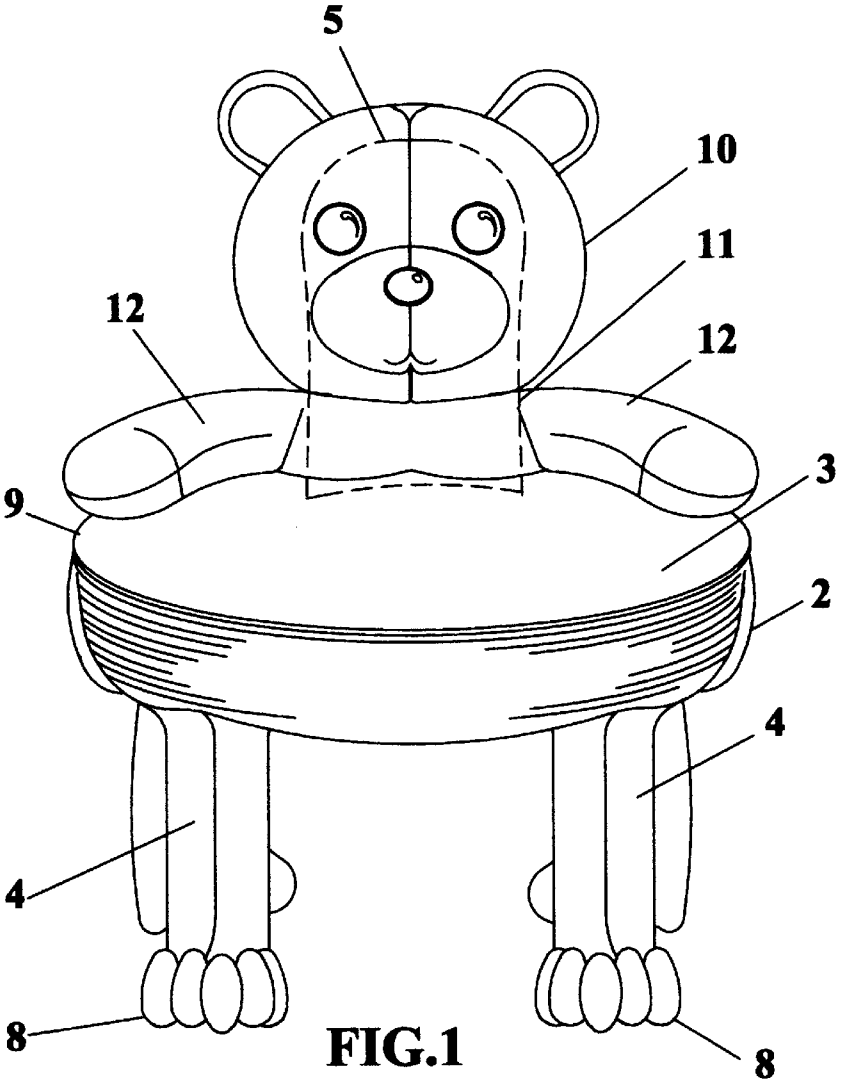
FIG. 1 illustrates a front perspective elevation view of the stool.
Figure 4:
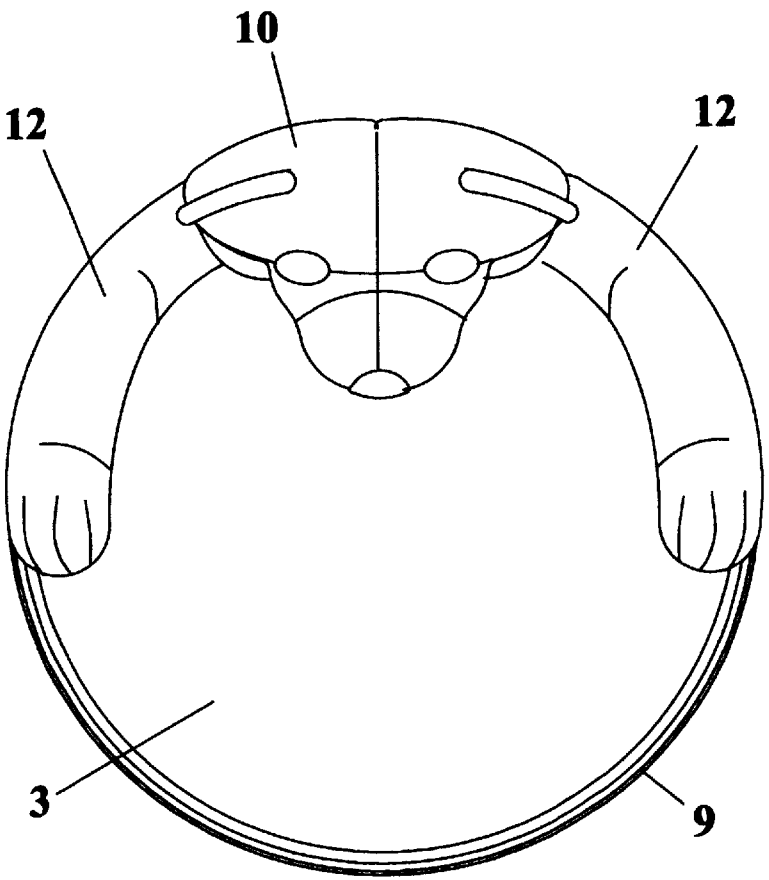
FIG. 4 illustrates a top plan view of the stool.
Figure 3:
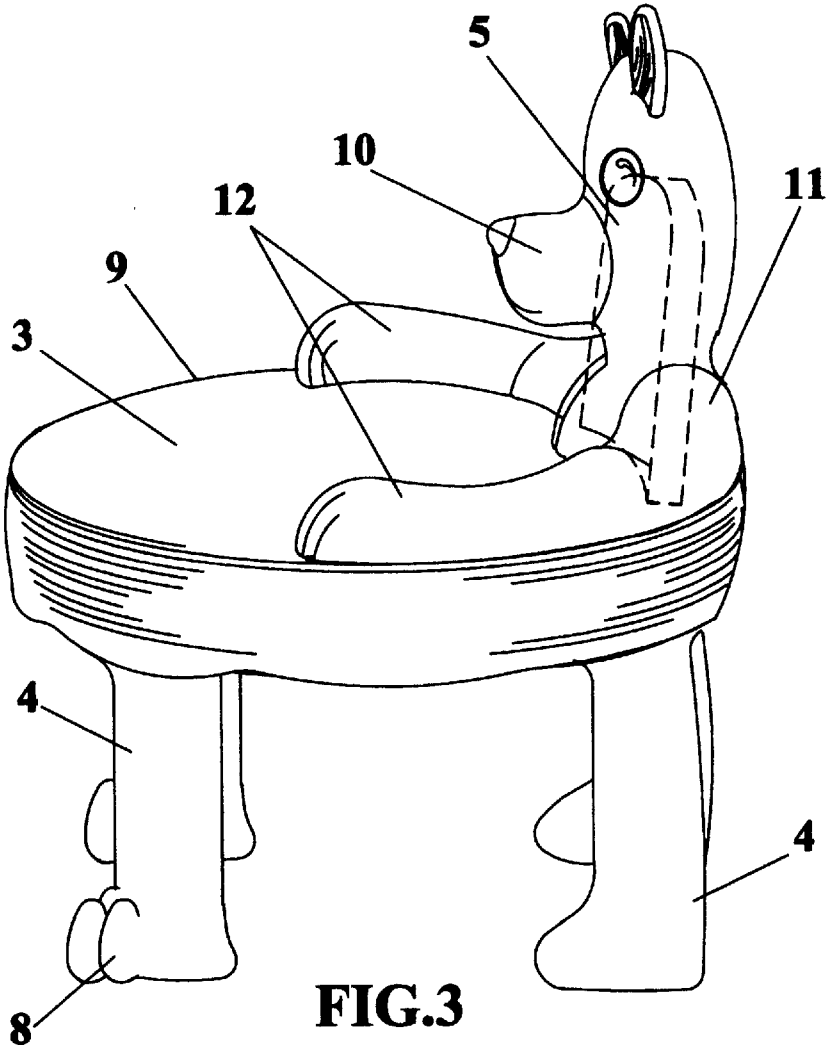
FIG. 3 illustrates a back perspective view of the stool.
Figure 6:
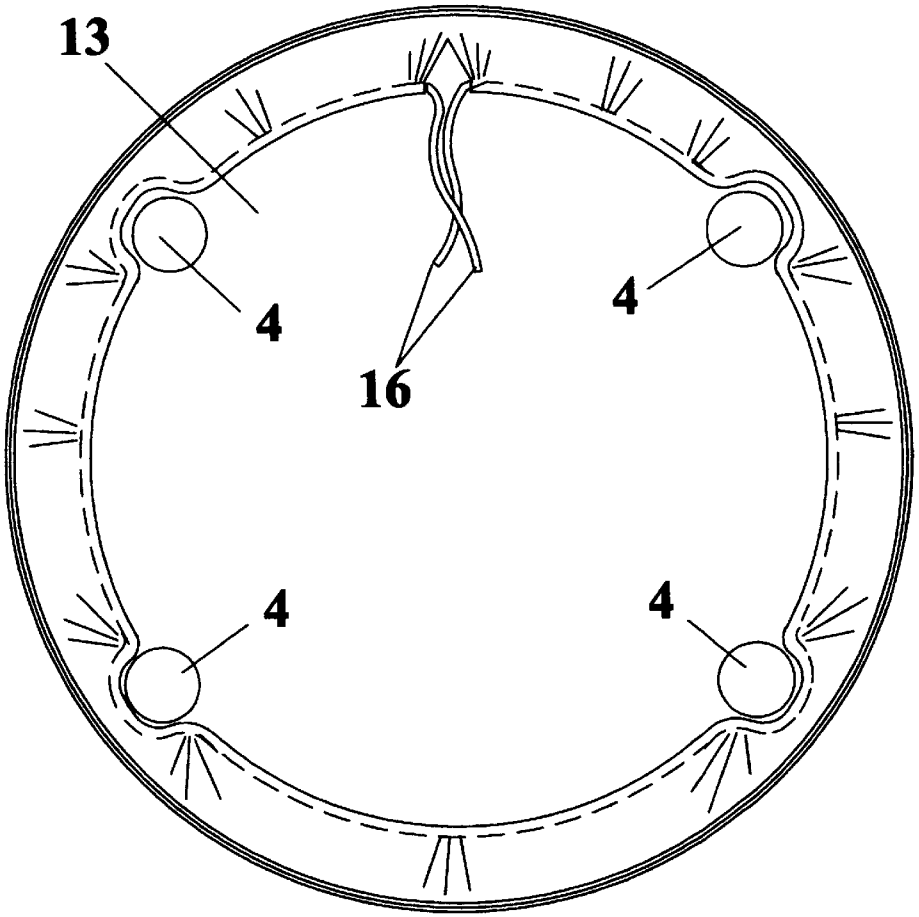
FIG. 6 illustrates a bottom plan view of the stool without the legs.
Figure 5:
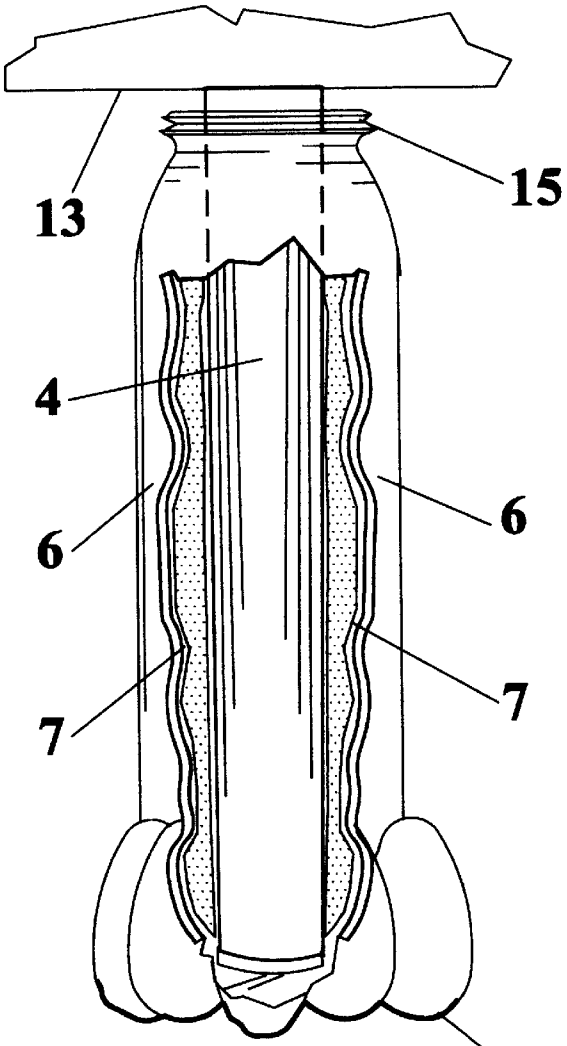
FIG. 5 illustrates a partial elevation view of a leg with cut away showing covering and stuffing elements of material and the structural leg member.

Referring to FIGS. 1 through 5, a stool (1) generally shaped to form the appearance of a bear over the structural members (2) of the stool (1) is illustrated. The structural members include the typical four legged stool having seat (3) or platform, four legs (4) and if desired back member (5). While a circular seat (3) is illustrated other shapes may be used as for example square form.

The seat (3) and legs (4) are substantially covered with a cloth material element (6) which is padded or stuffed with stuffing material (7) such as loose or sheet foam, kapok or formed sheets of padding material and the like which are soft yet resilient enough to be distorted and yet return to their former shape. The cloth material element (6) is generally closed around the stool (1) by sewing or use of fasteners. For ease of removal for cleaning or other purposes the cloth material element (6) may have elastic bands (15), draw strings (16) or the like for retaining the cloth material under the seat (3) and around the top of the legs (4). As can be seen the stuffing material (7) may be used to support the shape of the formed bear feet (8).

The character head or bear head (10) is formed over the back member (5) and includes partial shoulders (11) with arms (12) extending therefrom. The head (10) may also be attached at the edge (9) of the stool (1) without the use of a back member (5); the back member (5) serving merely to provide structure for support. Again as with the other portions of the stool the head (10) shoulders (11) and arms (12) have a cloth material element (6) as covering and to provide the bear appearance features which is stuffed as described previously. The material element (6) may be formed of a plush cloth fabric which may by painting, silk screening and the like create the animal appearance of facial features as well as feet and other features. The arms (12) extend from the shoulders (11) partially around the edge (9). While cloth has been used to describe the material element (6) other suitable covering may be used.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A stool comprising: a seat with four legs subtending therefrom wherein said seat has a perimeter edge; the seat and each leg substantially covered with a material element with a means for retaining said material element on said seat and said legs wherein the material element covering each leg covers a leg bottom and is formed and decorated to create the appearance of the foot of a character; and a head with a partial shoulder and two arms extending therefrom with the partial shoulder and each arm attached at the seat perimeter edge wherein the head, the partial shoulder and each arm are formed of the material element with stuffing material contained therein and have decorations to create the appearance of the character.

2. The stool as in claim 1 wherein there is a back member attached to the seat opposite the legs and located in the head and the partial shoulder.

3. The stool as in claim 1 wherein the material element decoration is sewn to create the appearance of facial and other features.

4. The stool as in claim 1 wherein the material element decoration is painted to create the appearance of facial and other features.

5. The stool as in claim 1 wherein the material element decoration is silk screened to create the appearance of facial and other features.

6. The stool as in claim 1 wherein the material element is a plush cloth fabric.

7. The stool as in claim 1 wherein the material element means for retaining on the seat is use of a draw string and on each leg is by use of a draw string.

8. The stool as in claim 1 wherein the material element means for retaining on the seat is by use of an elastic band and on each leg is by use of an elastic band.

* * * * *